US006299943B1

(12) United States Patent
Uden et al.

(10) Patent No.: US 6,299,943 B1
(45) Date of Patent: Oct. 9, 2001

(54) APPLICATION OF PLASTIC MATERIALS ONTO METALLIC COMPONENTS

(75) Inventors: Henk Van Uden, Uden (NL); Peter Fischer, Oberehrendingen (CH); Herbert Domes, Weilmunster (DE)

(73) Assignee: Metallgesellchaft Aktiengesellschaft, Frankfurt am Main (DE)

( * ) Notice: Subject to any disclaimer, the term of this patent is extended or adjusted under 35 U.S.C. 154(b) by 0 days.

(21) Appl. No.: 09/423,573

(22) PCT Filed: Jun. 16, 1998

(86) PCT No.: PCT/EP98/03617

§ 371 Date: Feb. 16, 2000

§ 102(e) Date: Feb. 16, 2000

(87) PCT Pub. No.: WO98/57759

PCT Pub. Date: Dec. 23, 1998

(30) Foreign Application Priority Data

Jun. 18, 1997 (DE) ..... 197 25 780

(51) Int. Cl.[7] ..... B05D 1/38
(52) U.S. Cl. ..... 427/379; 427/409
(58) Field of Search ..... 427/379, 409, 427/410

(56) References Cited

U.S. PATENT DOCUMENTS 2,550,232 * 4/1951 Donnell et al. ..... 427/409
4,948,633 8/1990 Wu .
5,603,818 * 2/1997 Brent et al. ..... 427/409

FOREIGN PATENT DOCUMENTS 4032391 4/1992 (DE) .
4339773 5/1995 (DE) .
19642970 4/1997 (DE) .
0623354 11/1994 (EP) .

OTHER PUBLICATIONS

Derwent Publication Ltd. London GB; Abstract ofJP 63 021140A (Kobe Steel Ltd), Dec. 1988.

* cited by examiner

*Primary Examiner*—Erma Cameron
(74) *Attorney, Agent, or Firm*—Fulbright & Jaworski, LLP

(57) ABSTRACT

The method of applying plastic material or layers containing plastic material onto metallic components is effected such that a) the components are brought in contact with a solution or dispersion containing 5 to 50 wt-% organic polymer, b) the solution or dispersion is dried on, c) the components are brought in contact with a qualitatively substantially identical solution or dispersion in accordance with stage a), which only contains 0.5 to 5 wt-% organic polymer, and d) are finally dried.

Preferably, the solution or dispersion contains a chromium (VI) and/or chromium(III) compound and/or adhesion-promoting pigments, flow-control agents and/or defoaming agents (additives). Further preferred aspects of the invention consist in that the components are brought in contact with a solution or dispersion having a temperature of 5 to 40° C., drying on in accordance with stage b) is effected at a temperature in the range from 40 to 60° C., and the final drying in accordance with stage d) is effected at an elevated temperature up to 200° C. The outstanding advantage of the invention lies in the use of the method for the pretreatment of the components for the subsequent powder coating.

7 Claims, No Drawings

APPLICATION OF PLASTIC MATERIALS ONTO METALLIC COMPONENTS

DESCRIPTION

This invention relates to a method of applying plastic material or layers containing plastic material onto metallic components as well as the use thereof as a pretreatment of the components for the subsequent powder coating.

On an industrial scale, all kinds of methods of applying plastic material or layers containing plastic material onto metallic workpieces are being used. Depending on the kind of the workpieces, the application can be performed without difficulties or involves considerable disadvantages. The treatment of strip, for instance, can easily be effected by means of roller coating. By means of an appropriate adjustment of the concentration of the plastics solution or dispersion to be applied and of the coating rollers a plastic layer of the required thickness can each be produced in one cycle.

What is also comparatively easy is the treatment of relatively large-surface spherical workpieces, which is mostly effected by means of electro-dipcoating or spray-coating.

What is, however, difficult is the coating of components, in particular when they have a spatial extension. The term components includes for instance convection surfaces of radiators, shelves, fence elements and crash barriers. Roller coating methods are excluded in this case. Spray coating methods are uneconomic in particular due to their high content of over-spray. Dip coating methods include the disadvantage that at the discharge points droplets of the plastics solution or dispersion are left, which after the subsequent drying are visible as bulge. Such bulge has a coating thickness which is about 30 to 50 times as high as that of the other surface portions. Even after a subsequent coating, these bulges are clearly visible. In addition to the hardly aesthetic appearance, the treated parts are virtually useless—depending on their intended use—also for lack of fitting accuracy.

It is the object of the invention to provide a method of applying plastic material or layers containing plastic material onto metallic components, which overcomes the known, in particular the aforementioned disadvantages and even at the discharge point produces coatings with a coating thickness that substantially corresponds with the coating thickness of the other plastic-coated surface portions.

This object is solved in that the method as described above is developed in accordance with the invention in that a) the components are brought in contact with a solution or dispersion containing 5 to 50 wt-% organic polymer, b) the solution or dispersion is dried on, c) the components are brought in contact with a qualitatively substantially identical solution or dispersion in accordance with stage a), but which only contains 0.5 to 5 wt-% organic polymer, d) and are finally dried.

By drying on it is meant that the liquid film produced by the treatment in accordance with process stage a) at the surface portions different from the discharge points has dried on completely. On the other hand, the polymer solution or dispersion present at the discharge points is slightly concentrated, but soluble or dispersible in the subsequent process stage c).

By the treatment in accordance with process stage c) a liquid droplet is produced at the discharge point(s) which is much thicker as compared to the other surface portions, but which as a result of the considerably lower concentration of the polymer solution or dispersion after the final drying in accordance with process stage d) leads to a coating which substantially has the same thickness as the coating of the other surface portions.

The rinsing with water, which is first of all suggested to remove the thickened liquid film at the discharge point(s) instead of process stage c), is not feasible, as at these points the bare metal surface would then be exposed.

The solutions or dispersions being used contain the usual polymers. Particularly suitable polymers include polyacrylates, polyurethanes, polyesters, polystyrene as well as epoxy, phenol, silicone, urea and/or melamine resins as well as copolymers thereof.

In accordance with a preferred aspect of the invention the polymer solution or dispersion should in addition contain a chromium(VI) and/or chromium(III) compound, preferably in a water-soluble form.

In accordance with a further preferred embodiment of the invention, the components are brought in contact with a solution or dispersion which in addition contains adhesion-promoting pigments, flow-control agents and/or defoaming agents. The content of the aforementioned additives should be about 0.5 to 10 wt-% of the polymer content (dry matter of the polymers=100%). There are used additives which are commonly used in plastic coating technology.

The pH value of the solution or dispersion being used expediently lies in the range from 1.5 to 10. When using acidified polymer concentrates the preferred pH value lies in the range from 2 to 4, and when using alkalized polymer concentrates in the range from 7.5 to 9.

Bringing the components in contact with the solution or dispersion may largely be effected in any desired way. Dip coating or flow coating methods are particularly suitable. The baths should expediently be recirculated. The duration of bringing into contact should be dimensioned such that a complete wetting is ensured. It generally lies in the range from a few seconds to one minute. The temperature of the solution or dispersion being used may be in the range between 5 and 40° C.

The drying on in accordance with stage b) subsequent to stage a) may be effected at room temperature. Depending on the thickness of the liquid film the drying period will be about 5 to 60 minutes. In accordance with a preferred aspect of the invention, drying on will, however, be effected at a temperature in the range from 40 to 60° C. In this case, a drying period of 1 to 3 minutes will usually be sufficient. In any case, the above notes on the term of drying on used here should be observed.

For the treatment of the components in process stage c) the notes made in process stage a) as to temperature, duration of the treatment, etc. are applicable.

The final drying may be effected at room temperature. Because of the increased rate of drying, the use of elevated temperatures up to 200° C. is, however, particularly advantageous. Depending on the chosen temperature, the final drying period is about 5 seconds to 60 minutes.

A prerequisite for the proper coating of the components is the purity thereof. As far it has not been achieved by means of a directly preceding treatment, such as an electrolytic zinc-plating or a hot-dip zinc-plating, a thorough cleaning/rinsing with water according to known methods must be effected. The cleaned components may be treated with a wet surface or after having been dried in accordance with the inventive method.

The inventive method is determined in particular for coating components made of steel, zinc-plated steel, aluminium, alloys thereof, as well as zinc and the alloys thereof, and components having such surfaces. It may be used for the sole treatment for a permanent protection against corrosion, and for the pretreatment prior to any coating. This method has a particularly significant importance for the pretreatment of components for the subsequent powder coating.

Depending on the concentration of the solution or dispersion being used, the coating thicknesses achieved by means of the inventive method are about 0.5 to 3 $\mu$m (based on the surface portions different from the discharge points).

In addition to the solution of the object in accordance with the invention the present method has further considerable advantages. It operates without waste water. Due to the substantially identical quality of the solution or dispersion used in process stage c), it is due to the occurring concentration as a result of the detachment of the droplets present at the discharge points that it may be supplied continuously or discontinuously to the solution or dispersion in accordance with stage a), or be used for preparing the same by means of the commercially available polymer concentrates, which usually contain 30 to 50 wt-% polymer.

The invention will now be described in detail and by way of example with reference to the following Examples.

EXAMPLES

The treatment was performed on previously cleaned and rinsed shelves of zinc-plated steel with a still wet surface.

The production of the layers containing plastic material was effected by means of dispersions which as polymer contained a copolymer of acrylic acid, acrylic acid ester, styrene and urethane. The concentration of the polymer and the further contents of ammonium dichromate and the usual additives are listed in Table 1.

TABLE 1

| Polymer dispersion | 1 | 2 | 3 | 4 |
|---|---|---|---|---|
| Copolymer | 13.35 pbw | 11.12 pbw | 6.67 pbw | 0.89 pbw |
| Ammonium dichromate | 0.45 pbw | 0.38 pbw | 0.23 pbw | 0.03 pbw |
| Additives | 1.20 pbw | 1.00 pbw | 0.60 pbw | 0.08 pbw |
| Water | 85.00 pbw | 87.50 pbw | 92.50 pbw | 99.00 pbw |

pbw = parts by weight

The treatment of the shelves was effected by dipping with a dipping period of 10 sec at a bath temperature of 20° C. In the Examples in accordance with the invention (Examples 1 to 3) the polymer dispersions were dried on after the dipping treatment for a period of 2 min at 50° C., then dipping was effected in accordance with the invention into the polymer dispersion 4. Here as well, the dipping period was 10 sec and the bath temperature was 20° C. Subsequently, the final drying was effected at 150° C. within a period of 2 min.

In the comparative experiments 1 to 4, only one dipping treatment was effected with polymer dispersions 1, 2, 3 and 4, and subsequently the final drying was effected. In Comparative Example 5, the polymer dispersion 4 was used for two dipping treatments. The treatment conditions each were identical with those of Examples 1 to 3. The results achieved are listed in Table 2.

TABLE 2

| | 1st dipping treatment | 2nd dipping treatment | Coating thickness at the discharge edge | Coating thickness of other surface |
|---|---|---|---|---|
| Example 1 | Polymer dispersion 1 | Polymer dispersion 4 | 3 $\mu$m | 1.8 $\mu$m |
| Example 2 | Polymer dispersion 2 | Polymer dispersion 4 | 3 $\mu$m | 1.5 $\mu$m |
| Example 3 | Polymer dispersion 3 | Potymer dispersion 4 | 3 $\mu$m | 1.0 $\mu$m |
| Comparative Example 1 | Polymer dispersion 1 | — | 95 $\mu$m | 1.8 $\mu$m |
| Comparative Example 2 | Polymer dispersion 2 | — | 70 $\mu$m | 1.5 $\mu$m |
| Comparative Example 3 | Polymer dispersion 3 | — | 35 $\mu$m | 1.0 $\mu$m |
| Comparative Exampie 4 | Polymer dispersion 4 | — | 3 $\mu$m | 0.1 $\mu$m |
| Comparative Example 5 | Polymer dispersion 4 | Polymer dispersion 4 | 3 $\mu$m | 0.2 $\mu$m. |

Hence it follows that in the inventive Examples 1 to 3 the coating thicknesses largely correspond with each other both at the discharge points and at the surface portions different from the discharge points. In Comparative Examples 1 to 4, however, the coating thicknesses at the discharge points are larger than those at the other surface portions by the factor 25 to 52. Moreover, in Comparative Example 4 the coating thickness at the surface portions different from the discharge point is insufficiently small.

Comparative Example 5 particularly illustrates that a two-stage dipping treatment with a polymer dispersion whose concentration in the first stage is too low, is insufficient as regards the coating thickness at the surface portions different from the discharge points.

What is claimed is:

1. A method of applying plastic material or layers containing plastic materials onto a metallic component, comprising a) contacting the component with a solution or dispersion containing 5 to 50 wt-% of at least one organic polymer, b) drying the solution or dispersion on the component, c) contacting the component with a qualitatively substantially identical solution or dispersion in accordance with step a) which only contains 0.5 to 5 wt-% organic polymer, and d) drying the component.

2. The method as claimed in claim 1, wherein said solution or dispersion further comprises at least one of the chromium compounds selected from a chromium (VI) compound and a chromium (III) compound.

3. The method as claimed in claim 1, wherein said solution or dispersion further comprises an additive selected from the group consisting of adhesion-promoting pigments, flow-control agents and deforming agents.

4. The method as claimed in claim 1, wherein the solution or dispersion has a temperature of 5 to 40° C.

5. The method as claimed in claim 1, wherein drying in step b) is effected at a temperature in the range from 40 to 60° C.

6. The method as claimed in claim 1, wherein the final drying in accordance with step d) is effected at from room temperature up to 200° C.

7. The method as claimed in claim 2, wherein said chromium compound is water-soluble.

* * * * *